United States Patent [19]

Estebanez et al.

[11] 3,989,006

[45] Nov. 2, 1976

[54] APPARATUS FOR SPRAYING AN INSULATING FOAM ON AN INSIDE WALL OF A TANK

[75] Inventors: Joseph Estebanez, Upton-by-Chester; Peter M. Linfield, Kelsall, near Chester, both of England

[73] Assignee: Shell Oil Company, Houston, Tex.

[22] Filed: June 16, 1975

[21] Appl. No.: 587,493

[30] Foreign Application Priority Data

June 21, 1974 United Kingdom ..... 27671/74

[52] U.S. Cl. ..... 118/306; 118/315

[51] Int. Cl.[2] ..... B05B 13/06; B05B 5/00

[58] Field of Search ..... 118/323, 306, 305, 254, 118/315; 15/246.5; 134/166 R, 167 R; 114/222

[56] References Cited

UNITED STATES PATENTS

| | | | |
|---|---|---|---|
| 2,383,402 | 8/1945 | Maurer et al. | 118/306 |
| 3,246,776 | 4/1966 | Spencer et al. | 15/246.5 |
| 3,426,973 | 2/1969 | Ordway | 118/323 X |
| 3,542,593 | 11/1970 | Pribbernan | 134/167 |
| 3,827,634 | 8/1974 | Hammelmann | 239/227 |

*Primary Examiner*—Ronald Feldbaum

[57] ABSTRACT

Apparatus for spraying plastic insulating material on the inner surfaces of the inner hull of a tanker for transporting liquefied gas, e.g. LNG, LPG, etc. The apparatus comprises a vertical column adapted to be mounted in a tank, hinged extendible arm rotatable around and up and down on the column, a carriage carried on the free end of the arm, and spraying apparatus on the carriage.

12 Claims, 2 Drawing Figures

APPARATUS FOR SPRAYING AN INSULATING FOAM ON AN INSIDE WALL OF A TANK

BACKGROUND OF THE INVENTION

The invention relates to an apparatus and to a method for treating a surface, in particular for spraying an insulating foam, for example polyurethane foam, on a wall. Examples of spraying apparatus may be seen in British patent No. 1,300,352, and in U.S. Pat. Nos. 3,460,177 and 3,783,819.

The invention relates to an apparatus of the above kind, which are particularly suitable for treating the inner surfaces of the walls of a tank of prismatic or of cylindrical shape, such as for example a tank for transporting or storing liquefied gases (natural gas, methane, propane). Tanks of this kind, in particular, for seagoing tankers, are described for example in applicant's British patent No. 1,173,424.

In this connection it is remarked that the expression "treating a surface" covers a number of different operations, such as spraying an insulating foam, for example polyurethane foam, on a surface, spraying paint on a surface, cleaning a surface, sandblasting or grinding a surface, or even rolling a surface.

SUMMARY OF THE INVENTION

The apparatus according to the invention comprises an extendible element mounted in such a way that it is rotatable in a horizontal plane around a longitudinal axis of a vertical column, a carriage adapted to carry a treating tool and mounted at or near the free end of the extendible element by means of a connection allowing movement about a vertical axis, and means for maintaining the treating tool at substantially a predetermined distance from said surface.

Preferably the said apparatus comprises driving means for rotating the extendible element in a horizontal plane around a longitudinal axis of the vertical column.

A suitable embodiment of the apparatus according to the invention comprises means for displacing the extendible element in a vertical direction along the vertical column and/or it comprises means for displacing the vertical column together with the extendible element in a vertical direction.

In particular, if it is desired to use the apparatus according to invention for spraying an insulating foam, such as polyurethane foam, on a surface, it is desirable that the apparatus comprises means for directing the treating tool perpendicular to the surface to be treated. This feature contributes to obtaining an insulating layer of good quality on the said surface.

The method according to the invention comprises maintaining a treating tool at a substantially predetermined distance from said surface, moving the tool at a substantially constant velocity parallel to the surface while activating the tool, wherein the tool is mounted on a carriage mounted at or near the free end of an extendible element by means of a connection allowing movement around a vertical axis, said extendible element being rotatable in a horizontal plane around a longitudinal axis of a vertical column.

When it is intended to spray a surface by means of the apparatus according to the invention the apparatus is provided with a spraying tool and the method according to the invention comprises rotating the extendible element in a horizontal plane around a longitudinal axis of the vertical column, causing the spraying tool to spray while directing the spraying tool perpendicular to the surface and maintaining the spraying tool at a predetermined distance from the surface.

BRIEF DESCRIPTION OF THE DRAWING

The invention will be further explained with reference to the drawings, wherein.

DESCRIPTION OF A PREFERRED EMBODIMENT

Figure 1:
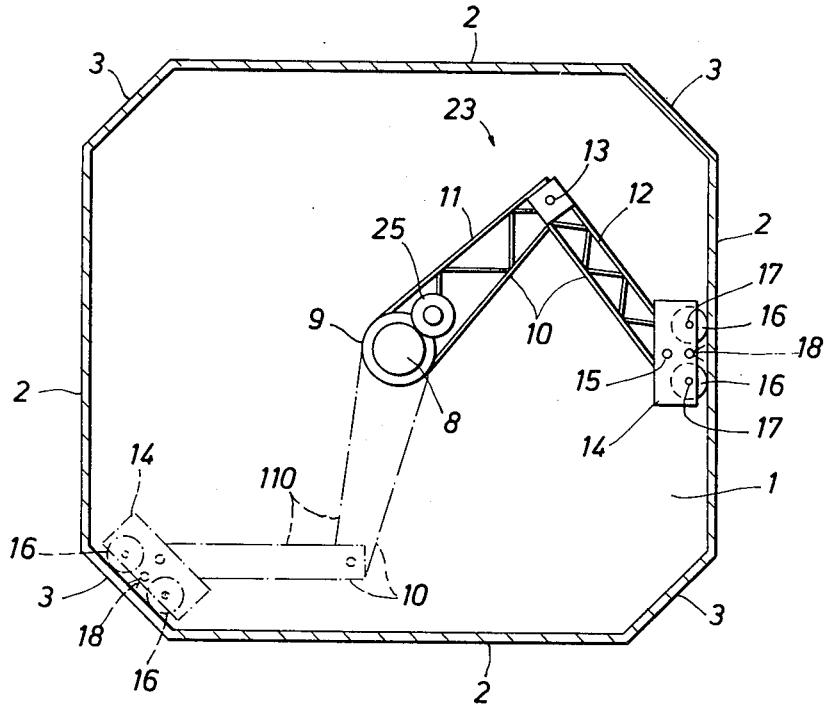
FIG. 1 shows a plan view of an embodiment of the apparatus according to the invention arranged within a tank to be treated.

The tank 1 as shown in the drawings comprises vertical side walls 2, vertical corner walls 3, a horizontal bottom wall 6, a horizontal top wall 7, inclined top walls 4 and inclined bottom walls 5. The horizontal top wall 7 is provided with a central tank opening 20. The tank 1, as shown, is the kind of tank which is normally present on tankers for the seagoing transport of liquefied gases, such as liquefied natural gas, methane or propane.

Figure 2:
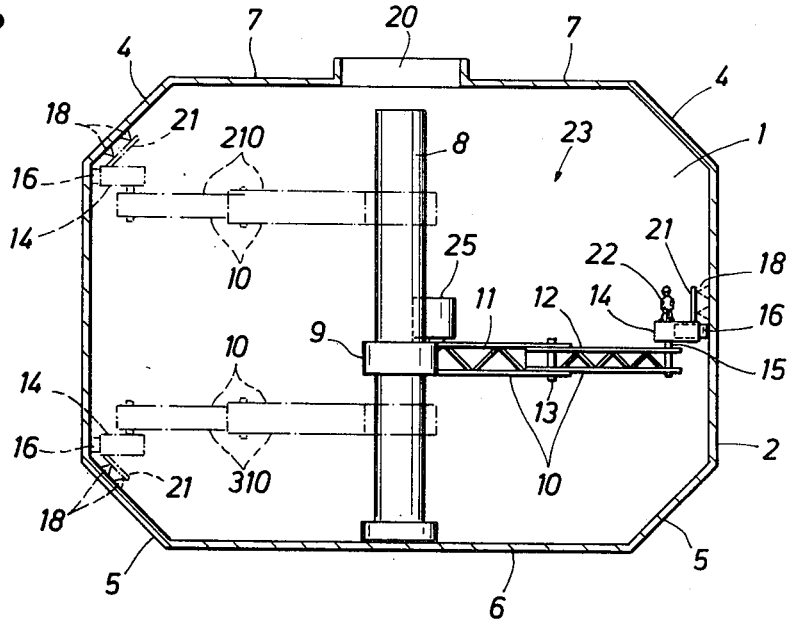
FIG. 2 shows an end elevation of the apparatus and tank according to FIG. 1.

When it is desired to treat the walls of the tank 1, the apparatus according to the invention, which is generally indicated by reference numeral 23, is placed within the tank 1 as shown in FIGS. 1 and 2. This can be done by lowering the column 8 through the central tank opening 20 and placing it on the horizontal tank bottom 6.

The column 8 may consist of one piece or it may consist of a number of sections which are put together within the tank 1, so that the column 8 will form a vertical column as shown in the drawings. Then an extendible element, which is generally indicated by reference numeral 10, is mounted in such a manner that it is rotatable in a horizontal plane around a longitudinal axis of the vertical column 8. The embodiment of the extendible element 10, as shown in FIGS. 1 and 2, is an articulated arm comprising two sections 11 and 12, which are interconnected at their ends by means of a vertical pin 13 so that they can pivot relative to each other. The other end of section 11 is provided with a ring 9 fitting around the vertical column 8 in such a manner that the ring is rotatable around column 8.

The extendible element 10 may consist of a number of sections which are put together within or outside the tank 1. At or near the free end of section 12 a carriage 14 is mounted by means of a connection allowing movement of the carriage 14 about a vertical pin 15.

The carriage 14 is provided with two rollers or wheels 16, each being rotatable around a vertical shaft or pin 17. The shafts 17 are so arranged that their vertical axes are spaced apart horizontally.

The carriage 14 is adapted to carry a treating tool. This treating tool can be a tool adapted to spray the walls of the tank 1, for example for spraying insulating foam, such as polyurethane foam or paint, onto the inner surfaces of the walls of the tank 1. Such a spraying tool is schematically shown in FIGS. 1 and 2 and is indicated by reference numeral 18.

If desired, instead of a spraying tool 18, other treating tools can be used in the apparatus according to the invention, for example a tool for cleaning a surface, a tool for sandblasting or grinding a surface, or a tool for rolling a surface.

In the drawings two spraying nozzles 18 are shown. These spraying tools 18 are secured to an arm 21 which is secured by one end of the carriage 14, preferably in such a manner that the arm 21 can be pivoted and positioned in a vertical plane. The carriage 14 is preferably provided with a platform for an operator 22.

In FIGS. 1 and 2 the apparatus 23 is shown in full lines during the treatment of a vertical side wall 2. Furthermore the apparatus 23 is shown in chain-dotted lines in three positions, viz. a first position 110, when it is treating a vertical corner wall 3, a second position 210, when it is treating an inclined top wall 4 and a third position 310 when it is treating an inclined bottom wall 5.

The apparatus according to the invention is operated in the following manner.

When it is desired to spray for example polyurethane foam on the inner surface of the vertical wall 2 a spraying tool 18 is mounted on the carriage 14 and this spraying tool 18 is caused to spray in a direction perpendicular to the wall 2. The extendible element 10 causes the wheels or rollers 16 to be urged against the wall 2. For this purpose the extendible element 10 is provided with suitable means of the hydraulic, pneumatic, electrical or mechanical type as known in the art (comprising for example plungers and cylinders, electromotors, springs). Then while the spraying tool 18 is spraying towards the wall 2, the extendible element 10 is caused to move in a horizontal plane around a longitudinal axis of the vertical column 8. This movement of the extendible element 10 can be obtained in different manners, for example by a man pushing against the extendible element 10 in a horizontal direction or by driving one or more of the rollers or wheels 16 of the carriage 14 by driving means such as a suitable motor (for example electric or hydraulic), or by driving the extendible element 10 by means of a suitable motor located on or adjacent to the column 8 for driving friction wheels 25 in contact with column 8. Preferably the extendible element 10 is driven in such a way that the tool 18 moves at a substantially constant velocity parallel to the surface to be treated.

Since the carriage 14 and the rollers or wheels 16 are urged towards the wall 2 and since the spraying tool 18 is mounted on the carriage 14, the tool 18 is automatically maintained at substantially a predetermined distance from the surface of the wall to be treated and moreover the tool 18 can easily be directed at a desired angle to the surface of the wall to be treated (for example perpendicular thereto).

When the carriage 14 reaches a vertical corner wall 3, the wheels 16 will move from the inner surface of vertical side wall 2 to the inner surface of vertical corner wall 3 (see chain-dotted lines, reference numeral 110 in FIG. 1). During this movement the tool 18 is continuously spraying, so that the inner surface of the wall 4 is treated as well. Then the wheels 16 will move from the inner surface of vertical corner wall 3 to the inner surface of the next vertical side wall 2. This process will be continued until the extendible element 10 has carried out a full rotation and a horizontal strip of the inner surfaces of the said walls has been treated. Then the extendible element 10 can be displaced in a vertical direction in order to treat a strip of the inner surfaces of the said walls below or above the first mentioned strip and this process is continued until the inner surfaces of walls 2 and 3 have been treated completely.

When it is desired to treat the inner surface of the inclined top wall 4, the arm 21 is pivoted and positioned in such a manner that it is parallel to, or substantially parallel to, the wall 4, as shown in FIG. 2 (chain-dotted lines reference numeral 210). Of course the arm 21 can be of any desired length as required.

The inner surface of the inclined top wall 4 is treated by causing the tool 18 to spray and by causing the extendible element 10 to move in a horizontal direction around a vertical axis of the column 8. In this way a horizontal strip of the inner surface of the wall 4 is treated. After completion a next strip of the wall 4 can be treated by displacing the extendible element 10 in a vertical direction and by repeating the process. In the position as shown by reference numeral 210 in FIG. 2, the wheels 16 run along the inner surface of wall 2. It is of course possible to cause the wheels 16 to run along the inner surface of the inclined top wall 4, if necessary.

The inner surface of the inclined bottom wall 5 can be treated basically in the same manner as the inner surface of the inclined top wall 4, the only difference being that in that case the arm 21 has to be mounted at the lower side of the carriage 14 in the manner as shown in FIG. 2 and as indicated by reference numeral 310.

In the method as described in the above, the apparatus according to the invention is used for spraying. If it is desired to use the apparatus for carrying out other operations, such as cleaning, sandblasting, grinding or rolling of said surfaces, the spraying tool has to be replaced by a suitable tool adapted to carry out said other operations. The use of the apparatus is however basically the same. Depending on the type of tool used the predetermined distance of the tool from the surface to be treated will have a different value. If rollers or grinding discs are used the value of said distance will be zero.

Attention is drawn to the fact that the vertical displacement of the extendible element 10, as mentioned above can be obtained by displacing the extendible element 10 in a vertical direction along the column 8 or by displacing the vertical column 8 together with the extendible element 10 in a vertical direction by suitable means as known in the art.

Furthermore, if desired, additional means can be present for carrying a tool on the extendible element 10 itself. If necessary, the extendible element 10 can be provided with a suitable counterweight to counterbalance the weight of the extendible element 10. It is also possible however to use two extendible elements 10 which are mounted opposite to each other in such a way that they counterbalance with each other.

In the preferred embodiment as shown in the drawings the extendible element 10 is in the shape of an articulated arm. Instead an extendible element 10 of the telescopic type can be used, if desired which is hydraulically or pneumatically operated.

Furthermore a power source can be used for producing hydraulic-, pneumatic- or electric power for operating the apparatus, said power source being mounted so as to be rotatable together with the extendible element 10.

In the embodiment as shown in the drawings, the tool is maintained at a predetermined distance from the surface to be treated by the fact that the carriage 14 is provided with rollers or wheels 16 so as to enable the carriage to ride along a surface. If desired the wheels 16 can be replaced by suitable runners so as to enable the carriage 14 to slide along a surface. Instead it is possible to use a carriage for carrying the tool which carriage is not provided with rollers or wheels or runners. Then a special control system is necessary for maintaining the carriage (together with a tool) at a predetermined distance from the surface, said control system being adapted to control the angular velocity of the extendible element and to adjust the extension thereof. Such a control system may consist of a system of cams enabling the carrying out of the above mentioned program. Instead suitable detecting means (for example electronic or sonic) may be used for measuring the distance of the carriage and the tool from the surface, wherein the signals produced are used for correcting the position of the carriage and the tool relative to the surface in such a manner that the carriage and the tool are always maintained at a predetermined distance from the surface.

The treating tool may consist of one or more rollers for rolling a surface, for example for squeezing epoxy resin into glass-fibre cloth arranged against a layer of polyurethane foam which has been sprayed on a tank wall.

We claim as our invention:

1. Apparatus for treating the inner walls of a tank forming a fluid-containing portion of an oil tanker, said apparatus comprising a central vertical column adapted to be substantially centrally mounted inside a tank to be treated, an extendible arm element having one end movably secured to said vertical column for vertical movement thereon and for rotational movement around the vertical axis thereof in a selectively fixed horizontal plane, a carriage mounted on the other end of said extendible arm element, said carriage being adapted to carry a treating tool, vertical pivot means connecting said carriage to said arm element for allowing movement of said carriage in a horizontal plane about the vertical axis of said pivot means, a treating tool mounted on said carriage and directed outwardly thereof toward the tank wall to be treated, and contact means fixedly carried by said carriage on the outer edge thereof for contacting the wall of the tank to be treated and maintaining the treating tool carried by said carriage at a predetermined distance from the wall.

2. An apparatus as claimed in claim 1 including driving means for rotating the extendible arm element in a horizontal plane around a longitudinal axis of the vertical column.

3. Apparatus as claimed in claim 1 including means for displacing the extendible element in a vertical direction along the vertical column.

4. Apparatus as claimed in claim 1 including means for displacing the vertical column together with the extendible element in a vertical direction.

5. Apparatus as claimed in claim 1 including means for directing the treating tool perpendicular to the surface to be treated.

6. Apparatus as claimed in claim 1 wherein the contact means is in the form of roller means having a vertical axis to enable the carriage to ride along the tank wall surface.

7. Apparatus as claimed in claim 6 wherein the roller means is provided with at least two rollers whose vertical axes are spaced apart horizontally.

8. Apparatus as claimed in claim 6 including driving means for driving at least one of the rollers.

9. Apparatus as claimed in claim 1 wherein the carriage is adapted to carry the treating tool by means of an arm secured by one end to the carriage.

10. Apparatus as claimed in claim 9 wherein the arm is so secured to the carriage that it can be pivoted and positioned in a vertical plane.

11. Apparatus as claimed in claim 1 wherein the extendible arm element is an articulated arm.

12. Apparatus as claimed in claim 1 including a platform for an operator arranged on the carriage.

* * * * *